United States Patent [19]

Kutz et al.

[11] Patent Number: 4,955,212

[45] Date of Patent: Sep. 11, 1990

[54] APPARATUS FOR TREATING A TEXTILE WEB WITH A LIQUID

[75] Inventors: Johannes Kutz, Tünisvorst; Günter von Harten, Kaarst-Buttgen, both of Fed. Rep. of Germany

[73] Assignee: Eduard Küsters Maschinenfabrik GmbH & Co. KG, Krefeld, Fed. Rep. of Germany

[21] Appl. No.: 219,802

[22] Filed: Jul. 14, 1988

Related U.S. Application Data

[63] Continuation of Ser. No. 919,223, Oct. 15, 1986, abandoned.

[30] Foreign Application Priority Data

Oct. 16, 1985 [DE] Fed. Rep. of Germany ..... 3536912
Sep. 9, 1986 [DE] Fed. Rep. of Germany ..... 3630592

[51] Int. Cl.[5] ..... D06B 1/02; D06B 15/04

[52] U.S. Cl. ..... 68/9; 68/20; 68/205 R

[58] Field of Search ..... 68/9, 19.1, 20, 175, 68/205 R; 134/64 R, 122 R

[56] References Cited

U.S. PATENT DOCUMENTS

| | | | |
|---|---|---|---|
| 3,955,385 | 5/1976 | Becker | 68/20 X |
| 4,050,982 | 9/1977 | Bolliand et al. | 68/175 X |
| 4,145,819 | 3/1979 | Fleissner | 68/20 X |
| 4,176,531 | 12/1979 | Fleissner | 68/20 X |
| 4,373,362 | 2/1983 | Fleissner | 68/20 X |
| 4,447,924 | 5/1984 | Bolton et al. | 68/20 X |
| 4,592,107 | 6/1986 | von der Eltz | 68/20 X |

FOREIGN PATENT DOCUMENTS

| | | | |
|---|---|---|---|
| 830040 | 1/1952 | Fed. Rep. of Germany . | |
| 1740815 | 3/1957 | Fed. Rep. of Germany . | |
| 2362109 | 6/1975 | Fed. Rep. of Germany . | |
| 1189989 | 4/1970 | United Kingdom | 68/175 |

*Primary Examiner*—Daniel P. Stodola
*Attorney, Agent, or Firm*—Kenyon & Kenyon

[57] ABSTRACT

In a fabric treatment apparatus for applying a washing or rinsing liquid to a dyed or printed textile web, the web is transported by a sieve conveyor belt along a horizontal path. Spaced from one another along that horizontal path are several liquid applicators or spray pipes. Associated with each spray pipe is a respect dwell stretch and a suction device, the dwell stretch being located downstream of the respective liquid applicator and upstream of the respective suction device. The dwell stretch includes either two sets of rotatable rollers spaced a distance from one another or a rotatable sieve drum.

10 Claims, 2 Drawing Sheets

APPARATUS FOR TREATING A TEXTILE WEB WITH A LIQUID

This application is a continuation of application Ser. No. 919,223, filed Oct. 15, 1986, now abandoned.

BACKGROUND OF THE INVENTION

This invention relates to an apparatus for treating a dyed or printed textile web with a liquid such as a washing or rinsing solution.

German Patent No. 830 040 discloses in principle a technique of spraying a treatment solution onto a moving textile web at several points spaced one behind the other along the direction of transport of the web, most of the solution applied at any particular spray station being removed from the fabric by suction before additional solution is applied to the web at a further point. In German Patent No. 830,040, the textile web is conducted freely, under small looping angles, along successive spray and suction pipes or over a suction drum, over the circumference of which drum spray pipes acting radially inwardly are distributed. Such a treatment of a fabric requires that the web have a minimum textile strength. Accordingly, the treatment is unsuitable for material such as knitted fabrics.

As disclosed in German Patent Document (Offenlegungsschrift) No. 23 62 109, an endless sieve belt passes over a pair of guide drums disposed at the same horizontal level, the cloth being spread out on an upper section or segment of the belt so that the cloth can be guided on the belt while the cloth is lying flat and completely slack. Above the upper section of the sieve belt, spray pipes are arranged for applying a washing or rinsing liquid to the cloth lying on the belt. Subsequently, the applied liquid, laden with dirt or dye residues, is removed by suction through the cloth and through the sieve belt.

The distance between the point of application of the liquid and the suction point is relatively short, with the consequence that the liquid has little time to act on the substances which are to be removed from the web.

German Petty Patent (Gebrauchsmuster) No. 17 40 815 discloses a boot-like water-filled washing chamber in which chamber the fabric is placed in a stacked configuration in order to lengthen the contact time of the washing liquid with the substances to be removed from the fabric web. This procedure, however, is unsuitable for many applications, exemplarily in the case of knitted materials, such knitted materials being difficult to draw out of the stack because of the sensitivity of the material to tension. The solution of the Gebrauchsmuster is also unsuitable in the case that the web is provided with printed matter, smudges in the printed matter arising upon stacking of the web.

An object of the present invention is to provide an improved apparatus of the above-described type.

Another, more particular, object of the present invention is to provide such an apparatus in which a washing or rinsing may be adequately effectuated without maintaining the textile web in a stacked configuration.

SUMMARY OF THE INVENTION

An apparatus for treating a dyed or printed textile web with a liquid comprises, in accordance with the present invention, a conveyor, a liquid applicator, a suction device and a dwell stretch. The conveyor includes an endless sieve belt for transporting the textile web along a predetermined substantially horizontal path. The applicator is disposed at a first station along a path for applying the liquid to the web during motion thereof along the path. The suction device is disposed at a second station along the path at a point downstream of the first station for removing the liquid from the web by a suction process during motion of the web along the path. The suction device preferably extends transversely to the web and to the belt and is disposed below and substantially juxtaposed to an upper section of the belt. The dwell stretch is disposed between the applicator and the suction device for conducting the textile web in a spread-out condition and in a single layer through at least one dwell loop.

In a fabric treatment apparatus in accordance with the present invention, the action time of the applied liquid on the substances to be removed from a fabric or textile web is lengthened. In one kind of application, a printing thickener has more time to swell. Because of the greater time that the washing or rinsing liquid has to act on the substances to be removed from the web, a surprising improvement of the washing effect can be achieved. Moreover, owing to the spread-out condition and the single-layer configuration of the textile web in the dwell loop, the tension in the textile web can be maintained at a small level.

In the case of printed material, a fabric treatment apparatus in accordance with the present invention is especially advantageous in that effective washing is possible without soiling a white background, inasmuch as the washing solution is spread onto the textile web and the cloth is neither placed into a stacked configuration nor run through a vat or the like.

A preferred area of application of the invention is so-called "soilage washing," because considerable amounts of soilage can be removed at relatively little expense. A fastness treatment as such may follow a washing operation in accordance with the invention.

In a particular embodiment of a fabric treatment apparatus in accordance with the present invention, the dwell stretch device is formed by an air pass, wherein the textile web is completely free of support or guiding elements at least along major portions of the dwell stretch or loop and is accordingly accessible to the atmosphere at all sides. An air pass may be formed in a known manner by a plurality of freely rotatable rollers arranged in two planes above the upper section of the sieve belt for guiding the web in a plurality of vertically extending loops above the upper section of the belt.

In an alternative embodiment of a fabric treatment apparatus in accordance with the present invention, the dwell stretch includes at least one freely rotatable drum disposed above the upper section of the sieve belt. The dwell loop extends around the drum. The dwell stretch further includes at least two rollers disposed laterally adjacent to one another below the drum for guiding the web to and from the drum. This particular embodiment of the fabric treatment apparatus in accordance with the invention is especially suitable for certain less resistant materials such as knitted fabrics. The web is conducted along a meander path from the belt path and back to the belt. The drum and rollers enable the textile web to be guided with particularly little tension.

A fabric treatment apparatus in accordance with the present invention can have a compact construction, particularly if the textile web is guided back from the dwell loop to the sieve belt at a point downstream and closely adjacent to the point where the web leaves the belt.

The suction device is advantageously disposed near the point of return of the web to the sieve belt. The suction device causes the textile web to adhere to the belt and to be entrained thereby. This entrainment of the textile web by the belt is sufficient to guide the web over several rollers not exhibiting any buoyance, or over drums, without any appreciable longitudinal tensile stresses occuring in the web.

Advantageously, in the second embodiment, the drum is made of a sieve material. However, other drum designs such as slats may also be utilizable in accordance with the present invention.

DETAILED DESCRIPTION

Figure 1:
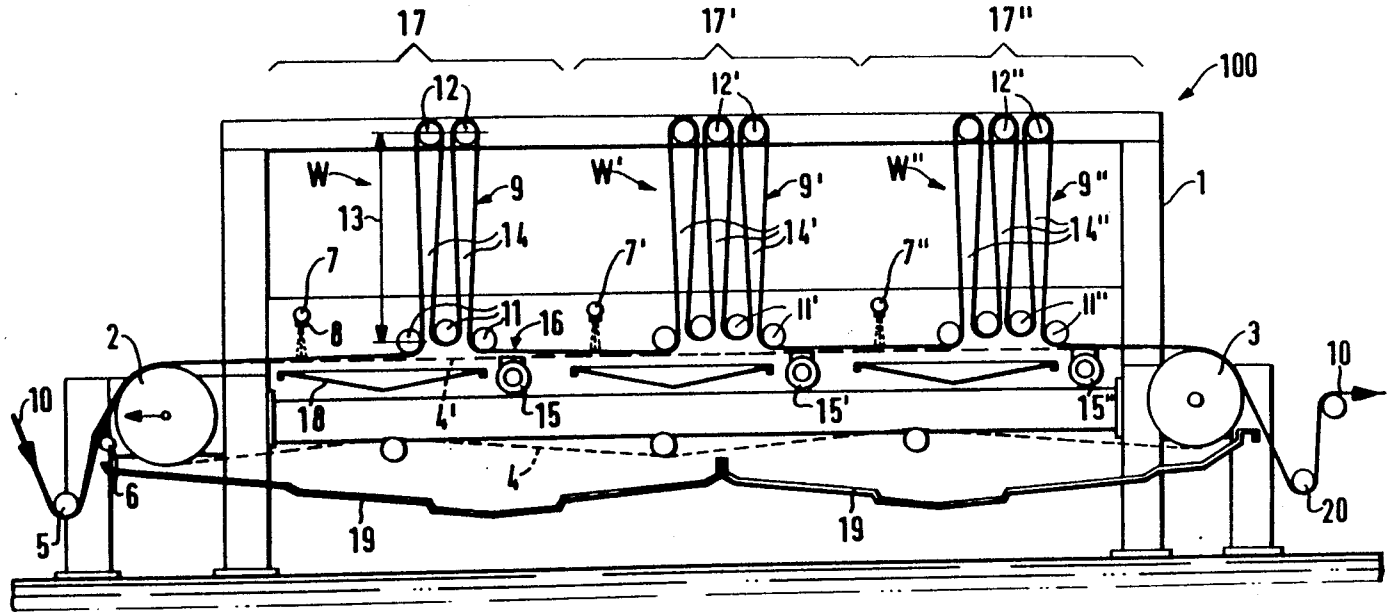
FIG. 1 is a partially schematic side elevational view of a fabric treatment apparatus in accordance with the present invention.

As illustrated in FIG. 1, a fabric treatment apparatus 100 comprises a scaffold type machine frame 1. A first guide drum 2 is rotatably mounted to machine frame 1 at an inlet side thereof, while a second guide drum 3 is rotatably mounted to machine frame 1 at an outlet side thereof. Guide drums 2 and 3 have essentially the same diameter and are arranged at approximately the same height above a floor base. An endless sieve belt 4 partially surrounds guide drums 2 and 3, sieve belt 4 having an upper section 4' extending approximately horizontally from guide drum 2 to guide drum 3. Guide drum 3 is driven to move upper section 4' of belt 4 from left to right in the drawing. Guide drum 2 is adjustable for tensioning sieve belt 4, as indicated by an arrow.

A gas-permeable textile web 10, arriving at fabric treatment apparatus 100 from a pretreatment apparatus such as a dying unit or a printing unit (not illustrated), is guided via a tension-compensating roller 5 into apparatus 100 over a full-width roller 6 and immediately thereafter onto sieve belt 4. Textile web 10 is guided in a single layer in a spread-out state and lies tensionless on upper section 4' of sieve belt 4. Textile web 10 then passes a spray pipe 7 having spray nozzles 8 distributed over the width of web 10, a washing or rinsing liquid being applied via nozzles 8 to the top side of textile web 10 substantially uniformly over the width thereof.

Subsequently, while being maintained in a single-layer spread-out state, textile web 10 passes through a dwell stretch W in the form of a so-called air pass 9. Air pass 9 includes a trio of lower rollers 11 closely juxtaposed to but not engaging each other and a pair of upper rollers 12 arranged at a distance 13 above lower rollers 11. Textile web 10 is guided between the lower rollers 11 and upper rollers 12 to form a pair of vertically extending dwell loops. Rollers 11 and 12 are all rotatably mounted to machine frame 1 and are entrained by textile web 10. In the short horizontal distance between the outer rollers of the lower trio of rollers 11, textile web 10 traverses a considerable dwell stretch corresponding to a multiple of distance 13, depending on the number of vertical dwell loops 14. Distance 13 is advantageously 1 to 2 meters.

As soon as textile web 10 again rests horizontally on upper section 4' of sieve belt 4 after passing the last roller of the lower trio of rollers 11, the web passes a suction device 15 provided with a suction pipe and a suction slit 16. Suction device 15 removes by suction, through textile web 10 and upper section 4' of sieve belt 4, the liquid applied by spray pipe 7 together with the greater part of the substances to be eliminated from the textile web.

Spray pipe or liquid applicator 7, air pass 9 and suction device 15 together form an assembly unit 17. As illustrated in FIG. 1, two further assembly units 17' and 17'' are spaced from one another and from assembly unit 17 along the path defined by upper sieve belt section 4'. Assembly unit 17' comprises a liquid applicator 7', a dwell stretch W' in the form of an air pass 9' and a suction device 15'. Air pass 9' includes four lower rollers 11' and 3 upper rollers 12', lower rollers 11' being spaced distance 13 from upper rollers 12'. Assembly unit 17'' comprises a liquid applicator 17'', a dwell stretch W'' in the form of an air pass 9'' and a suction device 15''. Air pass 9'' comprises a set of four lower rollers 11'' spaced distance 13 from a set of three upper rollers 12''. Textile web 10 passes through three dwell loops 14' and another three dwell loops 14'' in assembly units 17' and 17'', respectively.

A first set of catch plates 18 are provided below upper sieve belt stretch 4' and another set of catch plates 19 are provided below the lower section of sieve belt 4 for collecting liquid and returning it for recycled usage.

Upon leaving guide drum 3, textile web 10 passes over a tension-compensating roll 20 and is further processed. Further processing may include exemplarily a fastness treatment.

Figure 2:
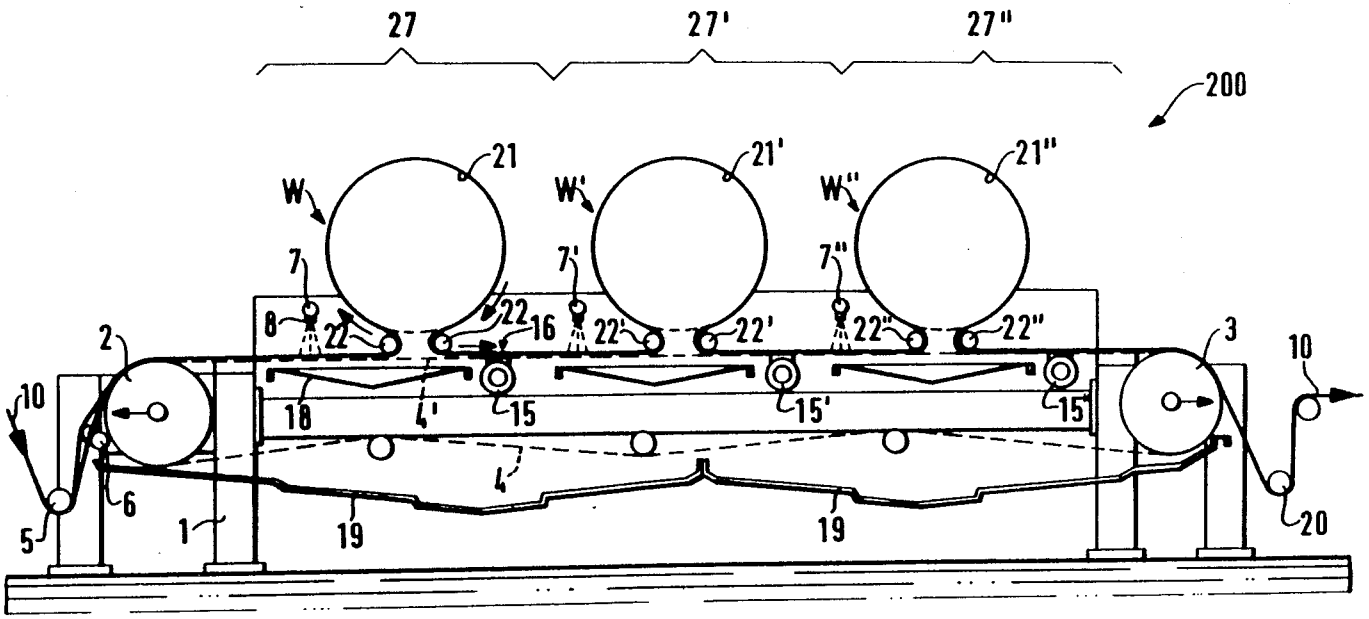
FIG. 2 is a partially schematic side elevational view of another fabric treatment apparatus in accordance with the present invention.

As illustrated in FIG. 2, another fabric treatment apparatus 200 in accordance with the present invention has many of the same elements as fabric treatment apparatus 100. The same elements are designated by the same reference numerals in the drawing. Apparatus 200 differs from apparatus 100 in the design of the dwell stretch.

Apparatus 200 comprises three dwell stretch assemblies 27, 27' and 27'' spaced from one another along the horizontal path taken by upper sieve belt section 4'. Assembly 27 includes first liquid applicator or spray pipe 7, dwell stretch W in the form of a sieve drum 21, and suction device 15. Sieve drum 21 is rotatably mounted to machine frame 1 at a distance above the plane of upper sieve belt section 4'. A pair of small-diameter guide rollers 22 are disposed below sieve drum 21 symmetrically with respect to a vertical plane passing through the axis of rotation of drum 21. Guide rollers 22 are spaced from one another along the path taken by upper sieve belt section 4'. Each guide roller 22 is closely juxtaposed on a lower side to upper sieve belt section 4' and on an upper side to drum 21.

The direction of motion of textile web 10 about drum 21 is indicated by arrows. The textile web passes partially around an upstream guide roller 22, whereby the direction of motion of the web is substantially reversed. The web is then guided around sieve drum 21 and deposited again on upper sieve belt section 4' upon passing partially around a downstream guide roller 22 and again reversing its direction of motion. Textile web 10 accordingly travels between guide rollers 22 over a meander path corresponding almost to the entire circumference of sieve drum 21.

Upon being deposited on upper sieve belt section 4', textile web 10 is subjected to suction from suction device 15, as described hereinabove with respect to FIG. 1. By the deposition of textile web 10 on sieve belt 4 and additionally by the action of suction device 15 disposed under upper sieve belt section 4' and closely juxtaposed thereto (suction device 15 causing textile web 10 to adhere to sieve belt 4 by suction), textile web 10 is taken along by sieve belt 4 and in turn entrains sieve drum 21 and guide rollers 22. Guide rollers 22 are rotatably mounted to machine frame 1 and can turn easily so that no appreciable tensions arise in the textile web.

Dwell stretch assembly 27' includes liquid applicator 7', dwell stretch W' in the form of a sieve drum 21', and suction device 15'. Two guide rollers 22' are disposed below sieve drum 21' on opposite sides of a vertical plane passing through the axis of rotation of sieve drum 21'. Guide rollers 22' are closely juxtaposed on a lower side to upper sieve belt section 4' and on an upper side to sieve drum 21'. Drum 21' and guide rollers 22' are rotatably mounted to machine frame 1 so that textile web 10 can travel along a meander path defined by guide rollers 22' and sieve drum 21'.

Assembly 27" comprises liquid applicator 7", dwell stretch W" in the form of a sieve drum 21", and a pair of guide rollers 22", and suction device 15". Sieve drum 21" and guide rollers 22" are rotatably mounted to machine frame 1, rollers 22" being closely juxtaposed on a lower side to upper sieve belt section 4' and on an upper side to sieve drum 21". Guide rollers 22" are closely juxtaposed to but spaced from one another along the path of upper sieve belt section 4' and are located symmetrically with respect to a vertical plane passing through the axis of rotation of sieve drum 21".

Although the invention has been described in terms of particular embodiments and applicaitons, one of ordinary skill in the art, in light of this teaching, can generate additional embodiments and modifications without departing from the spirit of or exceeding the scope of the claimed invention. Accordingly, it is to be understood that the drawings and descriptions herein are proffered by way of example to facilitate comprehension of the invention and should not be construed to limit the scope thereof.

What is claimed is:

1. An apparatus for washing or rinsing a dyed or printed textile web with a wash or rinse liquid, comprising:

conveyor means including an endless sieve belt for transporting said textile web along a predetermined substantially horizontal path;

applicator means disposed at a first station along said path for applying said wash or rinse liquid to said web during motion thereof along said path;

suction means disposed at a second station along said path at a point downstream of said first station for removing said wash or rinse liquid from said web by a suction process during motion of said web along said path, said suction means extending transversely to said belt and said web; and dwell stretch means, disposed between said applicator means and said suction means, for conducting said textile web in a spread out condition and in a single layer through at least one dwell loop thereby increasing the time period said wash or rinse liquid acts upon said web, said dwell loop extending a substantial distance away from said path in a direction substantially perpendicular thereto.

2. The apparatus defined in claim 1 wherein said dwell stretch means includes an air pass.

3. The apparatus defined in claim 2 wherein said air pass comprises means including several freely rotatable rollers arranged in two planes above an upper section of said belt for guiding said web in a plurality of vertically extending loops above said upper section of said belt.

4. The apparatus defined in claim 1 wherein said dwell stretch means includes at least one freely rotatable drum disposed above an upper section of said belt, said dwell loop extending around said drum, said dwell stetch means further including at least two rollers disposed laterally adjacent one another below said drum for guiding said web to and from said drum.

5. The apparatus defined in claim 4 wherein said drum takes the form of a sieve drum.

6. The apparatus defined in claim 1 wherein said suction means is disposed below and substantially juxtaposed to an upper section of said belt.

7. An apparatus for washing or rinsing a dyed or printed textile web with a wash or rinse liquid, comprising:

conveyor means including an endless sieve belt for transporting said textile web along a predetermined substantially horizontal path; and a plurality of treatment assemblies spaced from each other along said path, each of said treatment assemblies comprising:

applicator means disposed at a first station along said path for applying said wash or rinse liquid to said web during motion thereof along said path;

suction means disposed at a second station along said path at a point downstream of said first station for removing said wash or rinse liquid from said web by a 8. An apparatus for washing or rinsing a dyed or printed textile web with a wash or rinse liquid, comprising:

conveyor means including an endless sieve belt for transporting said textile web along a predetermined substantially horizontal path;

applicator means disposed at a first station along said path for applying said wash or rinse liquid to said web during motion thereof along said path;

suction means disposed at a second station along said path at a point downstream of said first station for removing said wash or rinse liquid from said web by a suction process during motion of said web along said path, said suction means extending transversely to said belt and said web, said suction means being disposed below and substantially juxtaposed to an upper section of said belt; and dwell stretch means, disposed between said applicator means and said suction means, for conducting said textile web in a spread out condition and in a single layer through at least one dwell loop thereby increasing the time said wash or rinse liquid acts on said web, said dwell stretch means including several freely rotatable rollers arranged in two planes above said upper section of said belt for guiding said web in a plurality of vertically extending loops above said upper section of said belt.

9. An apparatus for washing or rinsing a dyed or printed textile web with a wash or rinse liquid, comprising:

conveyor means including an endless sieve belt for transporting said textile web along a predetermined substantially horizontal path;

applicator means disposed at a first station along said path for applying said wash or rinse liquid to said web during motion thereof along said path;

suction means disposed at a second station along said path at a point downstream of said first station for removing said wash or rinse liquid from said web by a suction process during motion of said web along said path, said suction means extending transversely to said belt and said web, said suction means being disposed below and substantially juxtaposed to an upper section of said belt; and dwell stretch means, disposed between said applicator means and said suction means, for conducting said textile web in a spread out condition and in a single layer through at least one dwell loop thereby increasing the time period said wash or rinse liquid acts upon said web, said dwell stretch means including at least one freely rotatable drum disposed above said upper section of said belt, said dwell loop extending around said drum, said dwell stretch means further including at least two rollers disposed laterally adjacent one another below said drum for guiding said web to and from said drum.

10. The apparatus defined in claim 9 wherein said drum takes the form of a sieve drum.

* * * * *

UNITED STATES PATENT AND TRADEMARK OFFICE

CERTIFICATE OF CORRECTION

PATENT NO. : 4,955,212

DATED : September 11, 1990

INVENTOR(S) : Johannes Kutz et al

It is certified that error appears in the above-identified patent and that said Letters Patent is hereby corrected as shown below:

In Column 6, line 34, claim 7, insert after "..by a"

--suction process during motion of said web along said path, said suction means extending transversely to said belt and said web, said suction means being disposed below and substantially juxtaposed to an upper section of said belt; and dwell stretch means, disposed between said applicator means and said suction means, for conducting said textile web in a spread out condition and in a single layer through at least one dwell loop thereby increasing the time period said wash or rinse liquid acts upon said web, said dwell loop extending a substantial distance away from said path in a direction substantially perpendicular thereto.--

Signed and Sealed this

Sixth Day of October, 1992

*Attest:*

DOUGLAS B. COMER

*Attesting Officer*

*Acting Commissioner of Patents and Trademarks*